United States Patent [19]

Ogawa et al.

[11] Patent Number: 4,936,108

[45] Date of Patent: Jun. 26, 1990

[54] VAPOR PRESSURE-ADJUSTING VALVE AND REFRIGERATION SYSTEM USING SAME

[75] Inventors: Shinji Ogawa, Aichi; Yoshiharu Kajikawa, Hekinan; Isao Kuroyanagi, Anjo; Norimasa Baba, Nagoya; Toshio Ohara, Kariya, all of Japan

[73] Assignee: Nippondenso Co., Ltd., Kariya, Japan

[21] Appl. No.: 371,727

[22] Filed: Jun. 27, 1989

Related U.S. Application Data

[62] Division of Ser. No. 199,659, May 27, 1988, Pat. No. 4,870,834.

[30] Foreign Application Priority Data

May 29, 1987 [JP] Japan ..... 62-137119

[51] Int. Cl.[5] ..... F25B 41/04

[52] U.S. Cl. ..... 62/197; 137/494

[58] Field of Search ..... 62/217, 197; 137/494, 137/538

[56] References Cited

U.S. PATENT DOCUMENTS

| | | | |
|---|---|---|---|
| 3,064,447 | 11/1962 | Heidorn | 62/217 X |
| 3,121,373 | 2/1964 | Murphy et al. | 137/494 X |
| 3,180,107 | 4/1965 | Baker et al. | 62/217 X |
| 3,818,717 | 6/1974 | Peruglia | 62/217 |
| 4,129,995 | 12/1978 | Usami | 62/217 |
| 4,619,115 | 10/1986 | Weber | 62/217 |

*Primary Examiner*—William E. Tapolcai

*Attorney, Agent, or Firm*—Cushman, Darby & Cushman

[57] ABSTRACT

A refrigeration system for use in an automotive air conditioner comprises a compressor for compressing vapor-phase refrigerant, a condenser connected to the outlet of the compressor, an expansion valve connected to the outlet of the valve, and a vapor pressure-adjusting valve mounted in the passage extending from the evaporator to the compressor. When the vapor pressure inside this passage is less than a certain value, the adjusting valve reduces the flow of refrigerant from the evaporator to the compressor to maintain the vapor pressure constant. A part of the liquid-phase refrigerant on the downstream side of the condenser is added to the refrigerant evaporated by the evaporator, by means of the adjusting valve.

2 Claims, 7 Drawing Sheets

VAPOR PRESSURE-ADJUSTING VALVE AND REFRIGERATION SYSTEM USING SAME

This is a division of application Ser. No. 199,659 filed May 27, 1988, now U.S. Pat. Ser. No. 4,870,834.

FIELD OF THE INVENTION

The present invention relates to a vapor pressure-adjusting valve and also to a refrigeration system which uses such a valve and can be employed in an automotive air conditioner, for example.

BACKGROUND OF THE INVENTION

The prior art refrigeration system is shown in FIG. 8, where a compressor 801, a condenser 803, a receiver 805, an expansion valve 809, and an evaporator 813 are connected in turn. A vapor pressure-adjusting valve 815 is disposed between the evaporator 813 and the compressor 801 to maintain the pressure of gaseous refrigerant inside the evaporator 813 constant. When the cooling load drops and the vapor pressure inside the evaporator 813 falls, the adjusting valve 815 senses the pressure drop to reduce the flow of refrigerant from the evaporator 813 to the compressor 801. Thus the vapor pressure inside the evaporator 813 is prevented from dropping.

FIG. 9 shows a Mollier chart for illustrating the condition in which the vapor pressure-adjusting valve 815 operates to reduce the flow of refrigerant from the evaporator 813 to the compressor 801. At point A, the compressor 801 is absorbing refrigerant. At point B, refrigerant is expelled from the compressor 801 but is not yet drawn into the condenser 803. At point C, refrigerant flowing out of the condenser 803 is directed toward the expansion valve 809. At point D, refrigerant discharged from the expansion valve flows toward the evaporator 813. At point E, refrigerant flows out of the evaporator 813. The operation of the adjusting valve 815 is given by the lines defined by these points E-A.

In the aforementioned refrigeration cycle, when the vapor pressure-adjusting valve 815 is working to reduce the flow of refrigerant which is forced out of the evaporator 813 toward the compressor 801, the refrigerant flowing out of the valve 815 toward the compressor 801 is overheated gas (point A in FIG. 9). The valve 815 also acts to reduce the flow of refrigerant drawn into the compressor 801. Ideally all the sliding portions inside the compressor 801 should be cooled by a sufficient amount of refrigerant admitted into it. However, when the valve 815 is working as mentioned above, the flow of refrigerant drawn into the compressor 801 is low. Further, this refrigerant is overheated gas. Therefore, it is impossible to cool the compressor 801 sufficiently. Hence, the seal may deteriorate, or the sliding portions may seize because of excessive heat.

SUMMARY OF THE INVENTION

It is an object of the invention to provide a refrigeration system in which the compressor is prevented from being cooled insufficiently when the vapor pressure-adjusting valve operates.

The above object is achieved by a refrigeration system in which a part of the liquid-phase refrigerant on the downstream side of the receiver is added to the refrigerant evaporated by the evaporator when the vapor pressure-adjusting valve limits the flow of refrigerant entering the compressor. The resulting mixture is drawn into the compressor.

Since the liquid-phase refrigerant on the downstream side of the receiver is added to the overheated gaseous refrigerant drawn into the compressor, the drawn refrigerant becomes moister. Also, the flow of the refrigerant is increased because of the addition of the liquid-phase refrigerant. Consequently, every sliding portion inside the compressor can be cooled sufficiently.

DETAILED DESCRIPTION OF THE INVENTION

Figure 1:
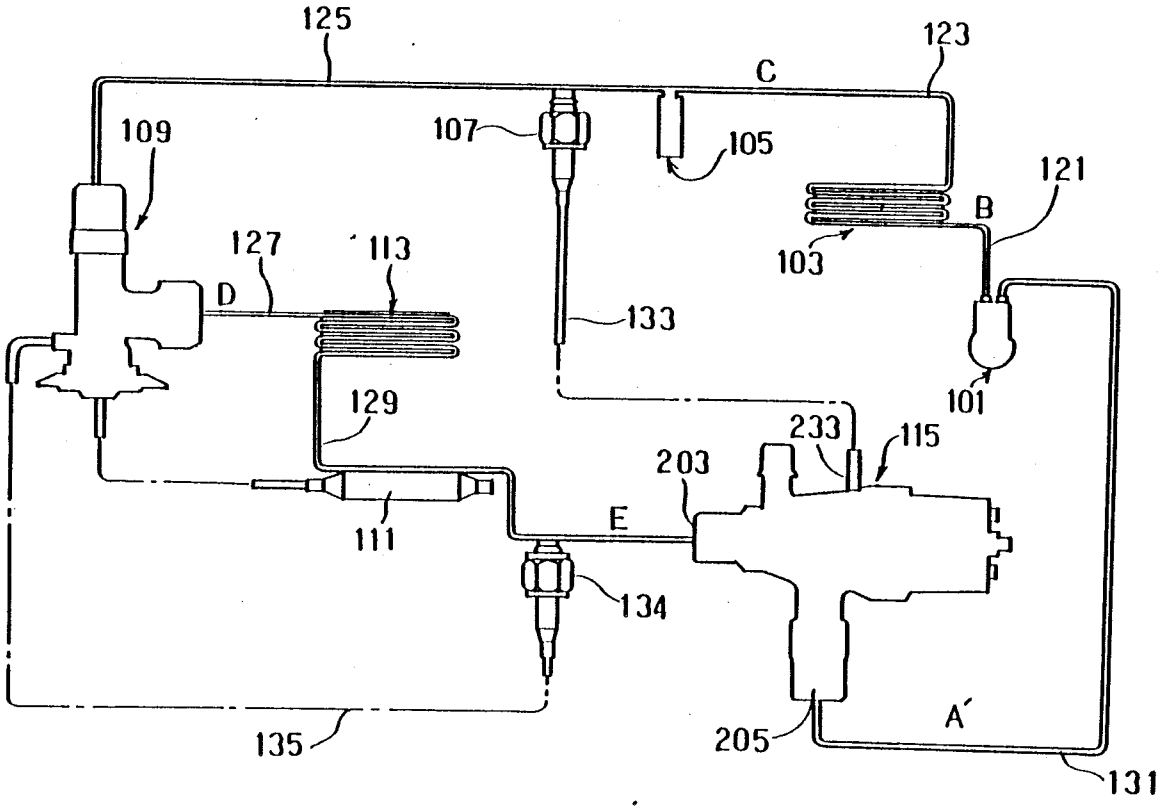
FIG. 1 is a diagram of the piping of a refrigeration system according to the invention.

Referring to FIG. 1, there is shown a piping for carrying out a refrigeration cycle according to the invention. The piping has a compressor 101 for compressing vapor-phase refrigerant into high-temperature, high-pressure, vapor-phase refrigerant. Any one of various known compressors, such as reciprocating, swash-plate, and sliding vane compressors, can be used as the compressor 101. The outlet port of the compressor 101 is connected to a condenser 103 by a tube 121. The condenser 103 is a known heat exchanger, and comprises a serpentine tube through which refrigerant flows. Fins are mounted between the neighboring straight portions of the serpentine tube. As refrigerant flows through the condenser 103, it exchanges heat with the outside air, whereby the refrigerant is cooled. As a result, the refrigerant is condensed, i.e., it is changed into a liquid state.

The outlet of the compressor 103 is connected with a receiver 105 via a tube 123. The liquid-phase refrigerant flowing into the receiver is separated into liquid phase and vapor phase. Only the liquid-phase refrigerant is allowed to flow through a tube 125 that is on the downstream side of the receiver 105. A bypass tube 133 (described in detail later) is connected with the tube 125 by a connector 107.

The pipe 125 is connected with the inlet port of an expansion valve 109 of a known structure. The refrigerant flowing into the valve 109 expands and is atomized. That is, the inside of the valve 109 has a low temperature and a low pressure. Then, the refrigerant flows from the outlet port of the valve 109 through a tube 127 and toward an evaporator 113. This evaporator 113 also consists of a known heat exchanger, and comprises a serpentine tube and heat-dissipating fins mounted between the adjacent portions of the serpentine tube. The refrigerant which flows through the evaporator 113 absorbs heat from the outside air and evaporates. That is, the refrigerant turns to a low-temperature, low-pressure gas. The evaporation of the liquid-phase refrigerant inside the evaporator 113 absorbs heat, lowering the temperature of the air. The air is forced into the passenger compartment to cool the inside of this compartment.

A vapor pressure-adjusting valve 115 has an inlet port 203 for admitting refrigerant. The outlet of the evaporator 113 is connected with the inlet port 203 by a tube 129. A heat-sensitive cylinder 111 for sensing the temperature of the refrigerant at the exit of the evaporator 113 is in contact with the tube 129 and connected with the expansion valve 109. A pressure-equalizing pipe 135 is connected via a connector 134 with the tube 129 from outside. Refrigerant is guided from the outlet of the evaporator 113 into the expansion valve 109 by the equalizing pipe 135.

The vapor pressure-adjusting valve 115 includes an outlet port 205 from which refrigerant is expelled, as well as the inlet port 203 connected with the exit of the evaporator 113 via the tube 129 as described above. The outlet port 205 is connected with the inlet port of the compressor 101 by a tube 131. The valve 115 has a bypass port 233 to which the aforementioned bypass tube 133 is connected.

Figure 2:
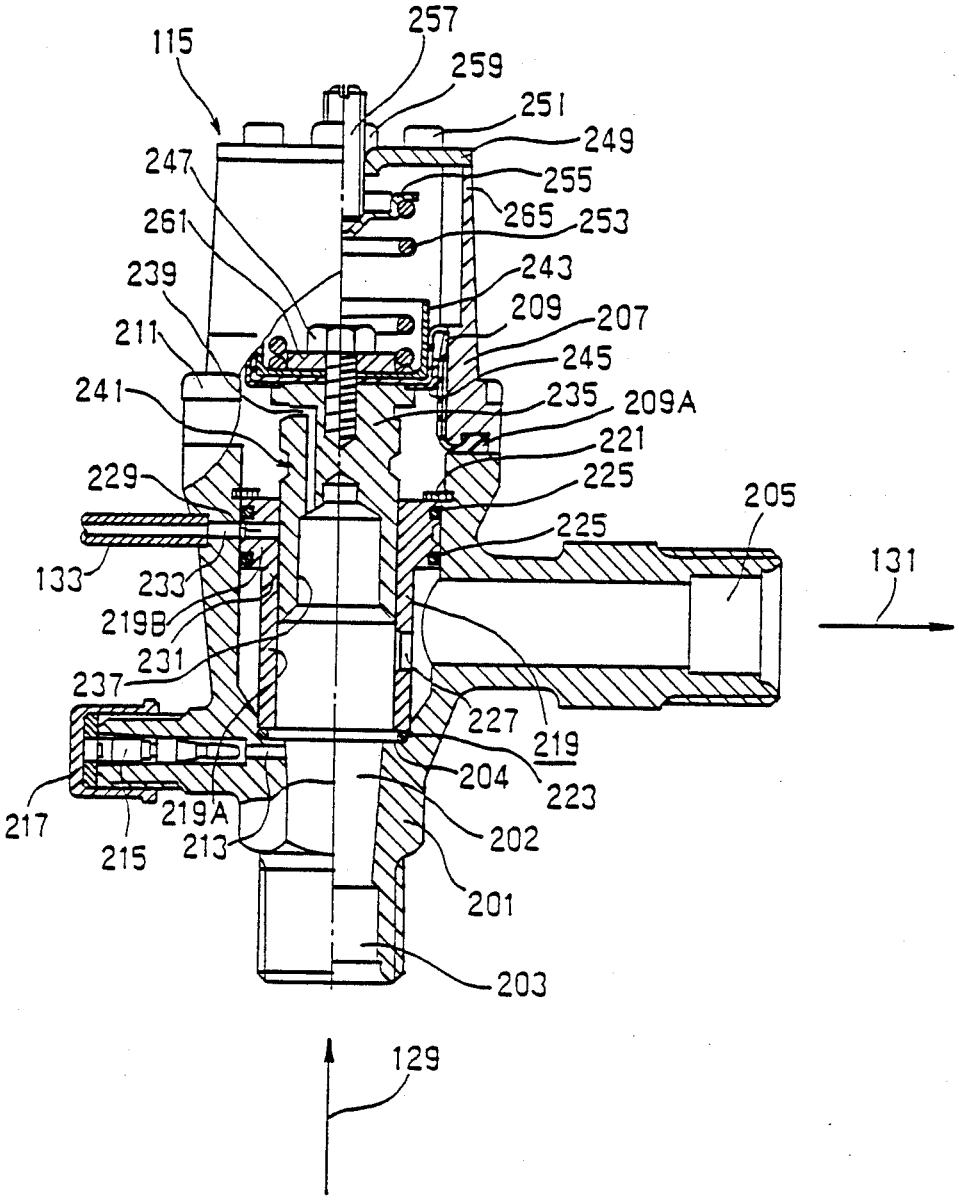
FIGS. 2 and 3 are cross-sectional views of the vapor pressure-adjusting valve shown in FIG. 1.

The internal structure of the vapor pressure-adjusting valve 115 is now described. FIG. 2 is a cross-sectional view of the inside of the valve 115. This valve 115 has a housing 201 molded out of aluminum. The housing 201 is provided with the inlet port 203 and the outlet port 205. The housing 201 is also formed with a passage 202 shaped like the letter "V". The ports 203 and 205 are in communication with each other through the passage 202. Further, the housing 201 has a port 213 used for detection of pressure, the port 213 being in communication with the passage 202. A pressure-detecting gauge is inserted into the port 213 to detect the pressure of refrigerant inside the passage 202. A worm valve 215 molded out of an elastic material, such as rubber, is disposed in the port 213. The end of the port 213 is closed off by a cap 217. Usually, the valve 215 prevents the refrigerant inside the passage 202 from leaking out through the port 213. When the cap 217 is removed and the pressure-detecting gauge is inserted, the valve 215 opens to place the gauge in communication with the passage 202.

The housing 201 is provided with the bypass port 233 to which the bypass tube 133 is connected as mentioned previously. This port 233 is located in such a position that it is aligned with a first passage 229 formed in a cylinder 219. This cylinder 219, shaped into a substantially cylindrical form, is disposed in the passage 202 in the housing 201. The cylinder 219 has a reduced portion 219A and an enlarged portion 219B. The outside diameter of the reduced portion 219A is less than the inner diameter of the passage 202 by a certain amount. The outer surface of the enlarged portion 219B is in contact with the inner wall of the passage 202. The open end of the reduced portion 219A bears on a shoulder portion 204 formed in the passage 202 via an O-ring 223 so as to maintain the seal. Two O-rings are fitted over the enlarged portion 219B to retain the seal between the enlarged portion 219B and the inner wall of the housing 201.

The first passage 229 is formed in the enlarged portion 219B between the two O-rings, and extends from the outer surface of the enlarged portion into the space inside the cylinder 219. A second passage 231 is formed near the junction of the enlarged portion 219B and the reduced portion 219A to place the surroundings of the outer surface of the reduced portion 219A in communication with the space inside the cylinder 219. The reduced portion 219A is provided with a third passage 227 to permit refrigerant flowing in through the inlet port 203 to pass through the space inside the cylinder 219 and flow out toward the outlet port 205.

A snap ring 221 is mounted on the upper surface of the enlarged portion 219B to firmly hold the cylinder 219. The outer surface of the ring 221 engages with the inner wall of the housing 201, while the inner surface abuts against the upper surface of the enlarged portion 219B. Thus, the reduced portion 219A of the cylinder 219 is pressed against the shoulder portion 204 via the O-ring 223. The cylinder 219 is maintained stationary while the first passage 229 is aligned with the bypass port 233.

A substantially cylindrical piston 235 is mounted in the cylinder 219 so as to be slidable. The piston 235 has a cutout portion 237 that faces the inlet port 203. A pressure-equalizing passage 239 is formed in the piston 235, and extends from one upper lateral side of the cutout portion 237 into the cutout portion. A communication groove 241 having given depth and width are formed in the whole outer surface of the piston 235.

A bellofram 209 is made of an elastic material, such as rubber, and has an outer end 209A. An upper housing 207 made of aluminum is coupled to the upper end of the housing 201 as viewed in FIG. 2 while holding the outer end 209A between the housings 207 and 201. The central portion of the bellofram 209 is held between an upper presser plate 243 and a lower presser plate 245. A bolt 247 located at the center of the bellofram 209 extends through a washer 261 and the bellofram and is screwed to the piston 235. The washer 261 is mounted on the upper presser plate 243. Since the bellofram 209 is connected to the piston 235 in this way, displacement of the bellofram is transmitted to the piston 235.

A cap 249 is fixed to the open end of the upper housing 201 with a screw 251. An adjusting screw 257 that is fixed by a retaining nut 259 is screwed into the cap 249. One end of the screw 257 bears against a spring support 255. A spring 253 is mounted between the spring support 255 and the upper presser plate 243 on the bellofram. The spring 253 biases the bellofram 209 and the piston 235 toward the inlet port 203. The load applied by the spring 257 under the initial condition can be adjusted by inserting the adjusting screw 257 more or less. The space in which the spring 253 is disposed is maintained at the atmospheric pressure by a hole 265 which is formed in the upper housing 207 so as to open into the atmosphere.

The structure constructed as described above operates in the manner described below. When the machine is run to perform a normal cooling operation, refrigerant is expelled from the evaporator 113 through the tube 129 at a pressure exceeding 2 $Kg/cm^2$. At this time, the pressure of the refrigerant passes through the inlet port 203, the cutout portion 237 in the piston 235, and the pressure-equalizing passage 239, and then acts on one side of the bellofram 209 the other side of which receives the biasing force of the spring 253. Since the pressure of the refrigerant is in excess of the biasing force, the piston 235 is located over the cylinder 219, as shown in FIG. 2. Therefore, the second passage 227 in the cylinder 219 is fully open to allow refrigerant to flow in through the inlet port 203. Then, it flows through the passage 202 and the outlet port 205, and is forced toward the compressor 101.

At this time, the first passage 229 in the cylinder 219 is closed off by the outer wall of the piston 235 and so the liquid-phase refrigerant flowing through the bypass tube 133 is cut off in the first passage 229.

It is now assumed that the cooling load decreases under the normal running conditions described above. Then, the vapor pressure inside the evaporator 113, i.e., the pressure of the refrigerant flowing through the tube 129, decreases. When the pressure of the refrigerant flowing in through the inlet port 203 is less than 2 $Kg/cm^2$, for example, the force of the refrigerant pushing the bellofram 209 upward as viewed in FIG. 2 becomes less than the force of the spring 253 urging the bellofram 209 downward. As a result, the piston 235 is moved downward by the biasing force of the spring 253.

As the piston 235 is moved downwardly through the cylinder 219, the opening of the third passage 227 is gradually narrowed by the outer wall of the piston 235. That is, the flow rate of the refrigerant which flows through the inlet port 203 and the third passage 227 toward the outlet port 205 decreases. As the piston 235 is reducing the area of the communicating opening of the third passage 227, the communication groove 241 gradually interconnects the first passage 229 and the second passage 231.

Figure 3:
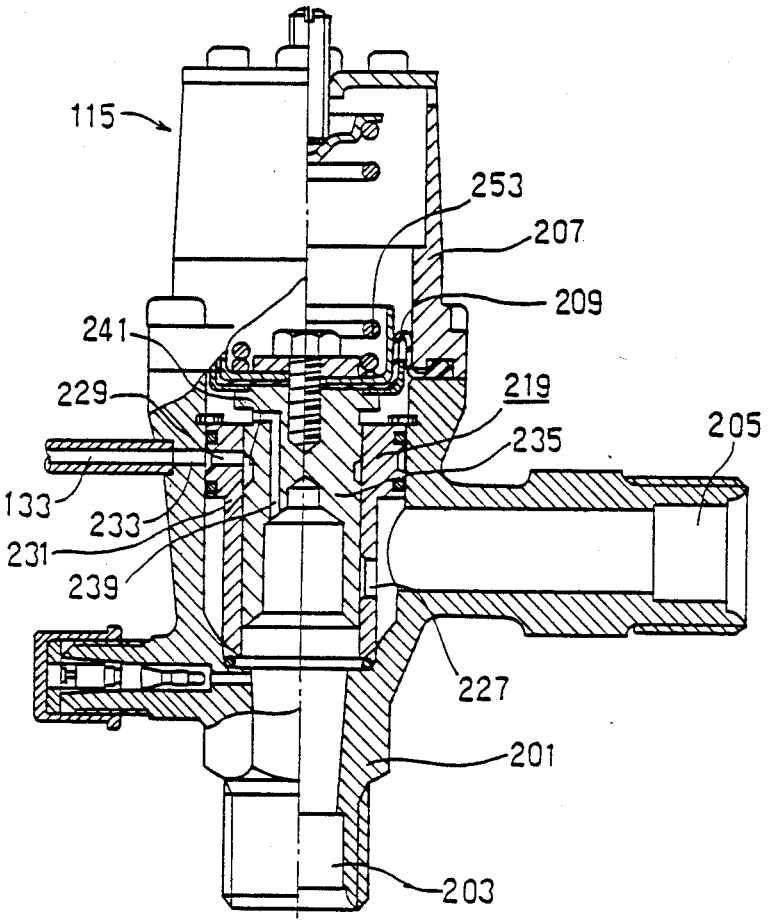

FIG. 3 shows the condition in which the piston 235 has been fully inserted in the cylinder 219. In this state, the third passage 227 is closed off by the outer wall of the piston 235. The first passage 229 is in full communication with the second passage 231 by way of the communication groove 241.

As the area of the opening of the third passage 227 is reduced in this way, the flow of the refrigerant flowing in through the inlet port 203 is limited by the third passage 227. This reduces the flow of the refrigerant flowing toward the compressor 101 through the outlet port 205. Complimentarily the first passage 229 is gradually connected with the second passage 231 via the communication groove 241. Thus, the liquid-phase refrigerant admitted through the bypass tube 133 flows through the bypass port 233, the first passage 229, the communication groove 241, the second passage 231, and arrives at the surroundings of the reduced portion 219A. Then, the refrigerant flows toward the compressor 101 through the outlet port 205 without being affected by the third passage 227. When the piston 235 is in the condition shown in FIG. 3, the liquid-phase refrigerant admitted through the bypass tube 133 is added to the refrigerant in the form of overheated gas which passes between the outer surface of the piston 235 and the inner wall of the cylinder 219 through the third passage 227 and toward the outlet port 205. Consequently, the moisture of the refrigerant drawn into the compressor 101 increases and, at the same time, the flow rate of the refrigerant is also increased. The sliding portions inside the compressor are lubricated with the increased amount of moisturized refrigerant.

Figure 6:
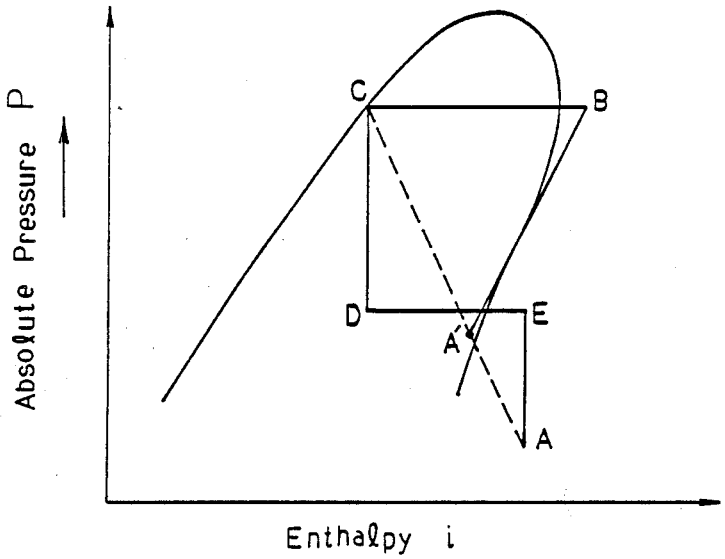
FIG. 6 is a Mollier chart for illustrating the operation of the system shown in FIG. 1.

FIG. 6 is a Mollier chart for showing the manner in which the vapor pressure-adjusting valve restricts the flow of refrigerant, as well as the way in which the liquid-phase refrigerant is added to the refrigerant drawn into the compressor. At point A, the vapor pressure-adjusting valve 115 prevents the liquid-phase refrigerant from being mixed into the gaseous refrigerant. At point A', the liquid-phase refrigerant is added to the gaseous refrigerant. Then, the compressor 101 compresses the refrigerant up to point B. Subsequently, the condition is shifted from point B to point C by the condenser 103. Thereafter, the state is caused to go from point C to point D by the action of the expansion valve 109. The condition is then shifted from point D to point E by the evaporator 113.

As can be seen from this chart, the condition in which refrigerant is drawn into the compressor 101 is indicated by point A'. The refrigerant is moister and lower in temperature at point A' than at point A. The vapor pressure-adjusting valve 115 reduces the flow of refrigerant from the evaporator 113 toward the compressor 101 to prevent the vapor pressure inside the evaporator 113 from falling below a certain value; otherwise the temperature of the vaporized refrigerant would also drop. If it should fall below 0° C, water vapor would be frozen on the fins of the evaporator 113.

Figure 4:
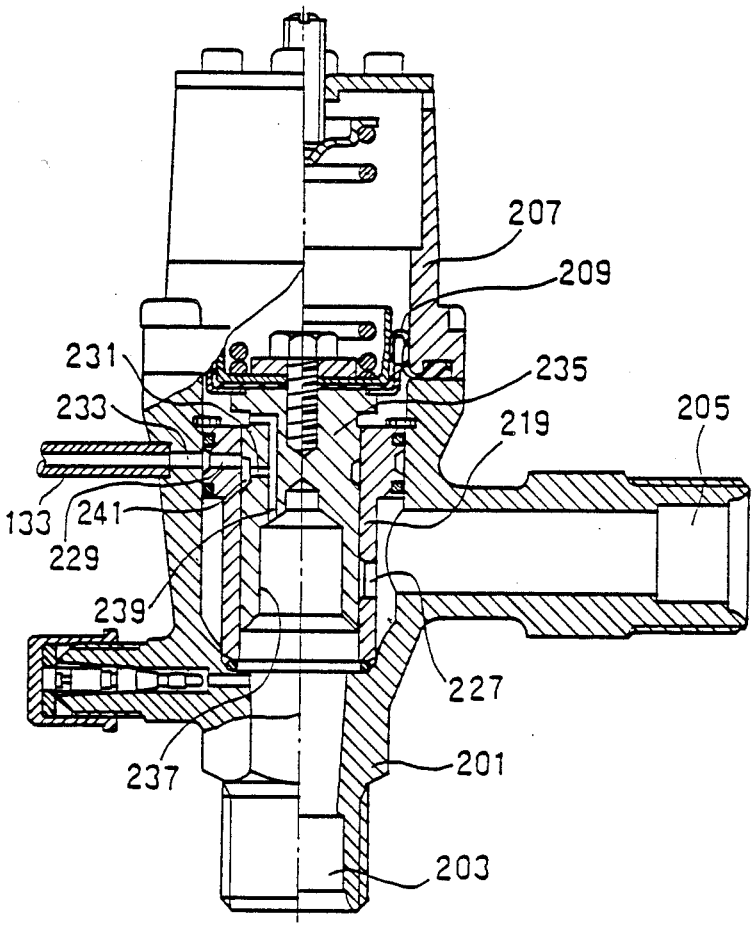
FIGS. 4 and 5 are cross-sectional views of other vapor pressure-adjusting valves.
Figure 5:
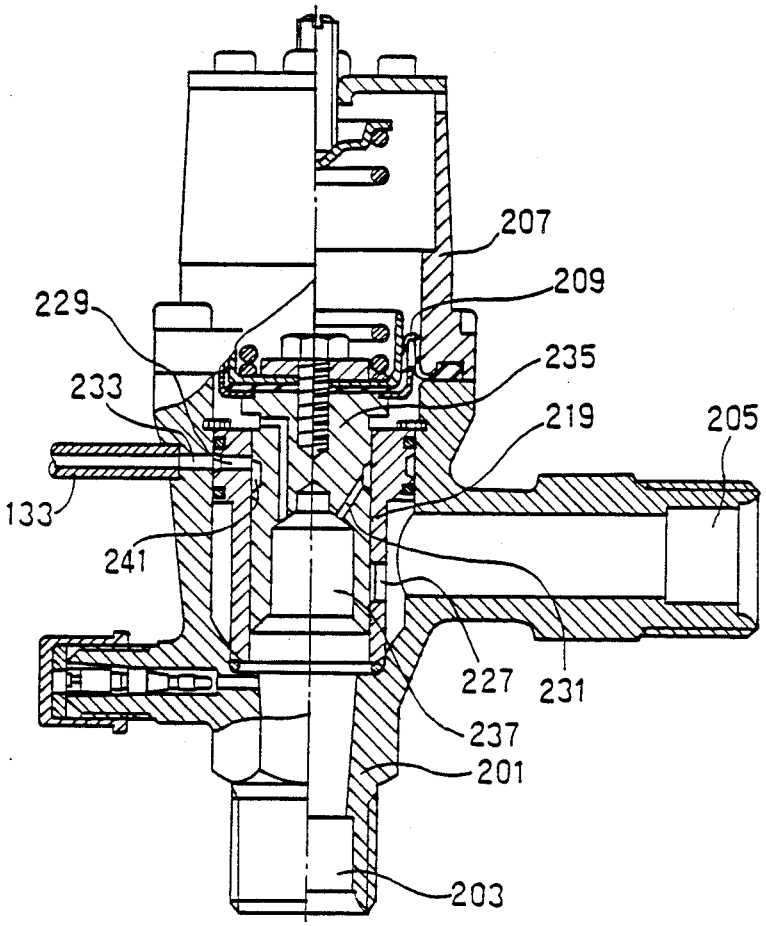

FIGS. 4 and 5 show other examples of the vapor pressure-adjusting valve 115. In the example shown in FIGS. 2 and 3, the second passage 231 which guides the liquid-phase refrigerant flowing in through the bypass tube 133 extends through both inner surface and outer surface of the reduced portion 219A. The liquid-phase refrigerant on the downstream side of the receiver 105 is added to the overheated gaseous refrigerant the flow of which is restricted by the third passage 227.

In the example shown in FIG. 4, the second passage 231 is so formed in the piston 239 that the communication groove 241 is connected with the pressure-equalizing passage 239. Thus, the liquid-phase refrigerant admitted through the bypass tube 133 passes through the bypass port 233, the first passage 229, the communication groove 241, the second passage 231 formed in the piston 235, and the pressure-equalizing passage 239. Then, it enters the cutout portion 237 in the piston 235. The refrigerant is added to the overheated gaseous refrigerant at a location on the upstream side of the third passage 227. The flow of the resulting mixture is reduced by the third passage 227, after which it flows into the compressor 101 through the outlet port 205.

In the example shown in FIG. 5, the second passage 231 is formed in the piston 235 in such a way that the communication groove 241 is in communication with the cutout portion 237. Thus, the liquid-phase refrigerant is added to the overheated gaseous refrigerant before the flow of the gaseous refrigerant is limited. The mixture is reduced in flow rate by the third passage 227.

Figure 7:
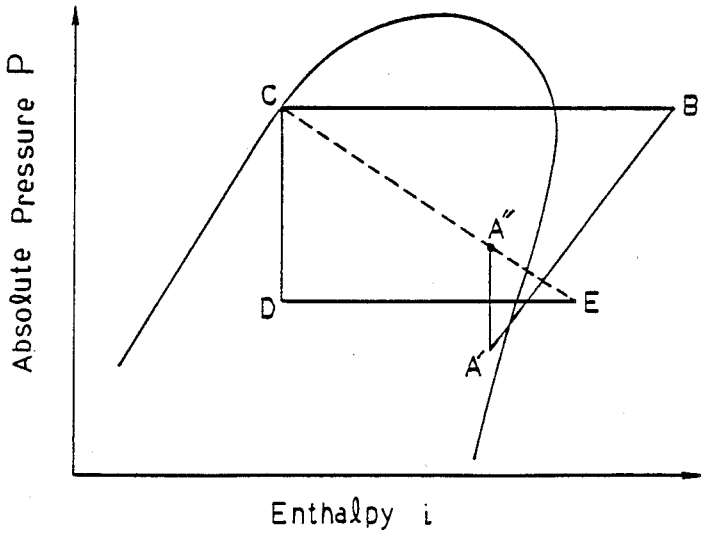
FIG. 7 is a Mollier chart for illustrating the operation of refrigeration systems using the adjusting valves shown in FIGS. 4 and 5.
Figure 8:
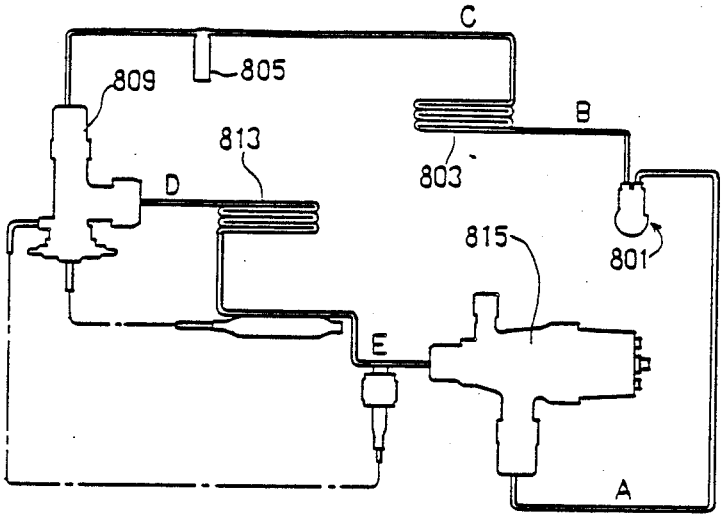
FIG. 8 (PRIOR ART)
FIG. 8 is a diagram of the piping of the prior art refrigeration system.
Figure 9:
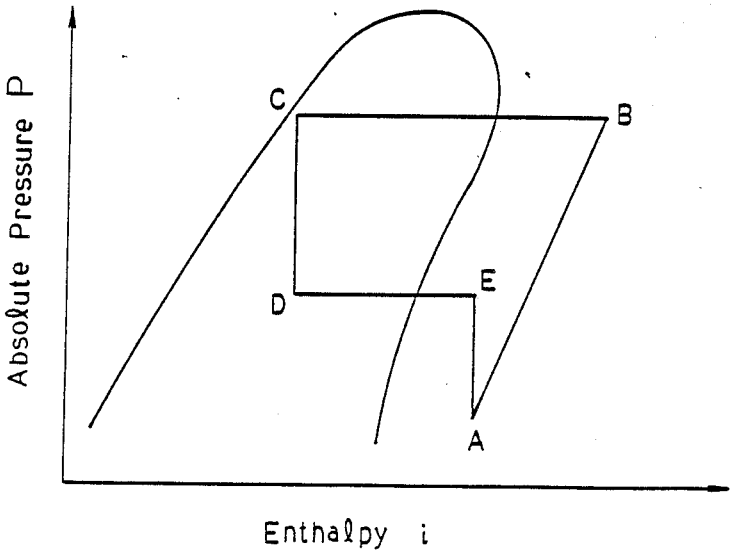
FIG. 9 (PRIOR ART)
FIG. 9 is a Mollier chart for illustrating the operation of the refrigeration system shown in FIG. 8.

FIG. 7 is a Mollier chart for illustrating the operation of the vapor pressure-adjusting valves shown in FIGS. 4 and 5. At point E, refrigerant just flows out of the evaporator 113, and the liquid-phase refrigerant is not yet added to it. At point A", the liquid-phase refrigerant is added. At point A', the flow of the mixture is limited. Then, the condition is shifted to point B by the compressor 101.

The vapor pressure-adjusting valves 115 shown in FIGS. 4 and 5 are similar in structure and operation to the valve shown in FIGS. 2 and 3 except for the foregoing. Therefore, these similar points are not described. In the example shown in FIG. 1, the expansion valve 109 is of the externally equalizing type. It can be also of the internally equalizing type or other structure.

What is claimed is:

1. A vapor pressure-adjusting valve comprising:

a housing which forms a part of a passage interconnecting an evaporator and a compressor and which is provided with a bypass port for admitting a part of the liquid-phase refrigerant condensed by the condenser; and a valve means responding to the pressure of the refrigerant admitted into the passage in such a way that as the pressure decreases, the valve means reduces the flow of refrigerant flowing out through the passage and places the bypass port in communication with the passage.

wherein said valve means comprises:

a cylinder having a side wall provided with a restriction passageway located in said passage; and a pillar-like piston that slides within the cylinder to increase or decrease the area of the opening of the restriction passageway by its outer wall and to enable or disenable the use of the restriction passageway connecting the bypass port with the passage.

2. The vapor pressure-adjusting valve of claim 1, wherein a bellofram like a diaphragm is connected to one side of the piston, one side of the bellofram being biased at a given pressure, and wherein the other side of the bellofram receives the pressure of the admitted refrigerant, whereby the bellofram is displaced.

* * * * *